US010173224B2

(12) United States Patent
Carra et al.

(10) Patent No.: US 10,173,224 B2
(45) Date of Patent: Jan. 8, 2019

(54) HYDRODYNAMIC REMOVAL OF DENSE MATERIALS FROM A SLURRY

(71) Applicant: BTA International GmbH, Pfaffenhofen (DE)

(72) Inventors: Roland Carra, Munich (DE); Patrick Fluck, Munich (DE); Tobias Ziegler, Freising (DE)

(73) Assignee: BTA INTERNATIONAL GMBH, Pfaffenhofen (DE)

( * ) Notice: Subject to any disclaimer, the term of this patent is extended or adjusted under 35 U.S.C. 154(b) by 0 days.

(21) Appl. No.: 15/564,266

(22) PCT Filed: Jun. 3, 2016

(86) PCT No.: PCT/EP2016/062601
§ 371 (c)(1),
(2) Date: Oct. 4, 2017

(87) PCT Pub. No.: WO2017/016718
PCT Pub. Date: Feb. 2, 2017

(65) Prior Publication Data

US 2018/0133721 A1 May 17, 2018

(30) Foreign Application Priority Data

Jul. 28, 2015 (DE) ..... 10 2015 112 254

(51) Int. Cl.
*B03B 13/00* (2006.01)
*B03B 5/34* (2006.01)
(Continued)

(52) U.S. Cl.
CPC ..... *B03B 5/34* (2013.01); *B03B 9/00* (2013.01); *B03B 9/06* (2013.01); *B03B 13/00* (2013.01);
(Continued)

(58) Field of Classification Search
CPC .... B03B 5/34; B03B 9/00; B03B 9/06; B03B 13/00; B04C 5/14; B04C 5/18; B04C 9/00
(Continued)

(56) References Cited

U.S. PATENT DOCUMENTS 3,017,767 A * 1/1962 Mossberg ..... G01N 7/00 137/91
3,421,622 A * 1/1969 Wurtmann ..... D21D 5/26 209/728
(Continued)

FOREIGN PATENT DOCUMENTS

DE 19505073 A1 8/1996
EP 0138475 A2 4/1985
(Continued)

OTHER PUBLICATIONS

International Search Report for PCT/EP2016/062601 dated Aug. 31, 2016.

*Primary Examiner* — Joseph C Rodriguez
(74) *Attorney, Agent, or Firm* — Buchanan Ingersoll & Rooney PC

(57) ABSTRACT

The invention relates to a device and to a method for the hydrodynamic removal of dense materials from a suspension, said device comprising a hydrocyclone (1), which holds the suspension, a classifying tube (2), which adjoins the hydrocyclone, and a storage chamber (3), which holds the removed dense materials, wherein a flushing water flow to the classifying tube (2) and a flushing water flow to the storage chamber (3) are provided, which can be controlled in a closed-loop or open-loop manner by means of a control element provided at the feed to the classifying tube and a control element provided at the feed to the storage chamber, respectively.

20 Claims, 4 Drawing Sheets

(51) Int. Cl.

| | |
|---|---|
| ***B04C 5/14*** | (2006.01) |
| ***B04C 9/00*** | (2006.01) |
| ***B03B 9/00*** | (2006.01) |
| ***B03B 9/06*** | (2006.01) |
| ***B03B 13/02*** | (2006.01) |
| ***B03B 13/04*** | (2006.01) |

(52) U.S. Cl.
CPC ..... *B03B 13/02* (2013.01); *B03B 13/04* (2013.01); *B04C 5/14* (2013.01); *B04C 9/00* (2013.01)

(58) Field of Classification Search
USPC ..... 209/726, 731, 733
See application file for complete search history.

(56) References Cited

U.S. PATENT DOCUMENTS 3,503,503 A * 3/1970 Ramond ..... D21D 5/18 209/729
3,543,931 A * 12/1970 Rastatter ..... B04C 5/28 209/711
3,543,932 A * 12/1970 Rastatter ..... B04C 5/28 209/728
3,869,559 A * 3/1975 Clark ..... B03B 5/34 134/26
3,989,628 A * 11/1976 Bier ..... B01D 35/20 210/255
4,267,048 A * 5/1981 Ohishi ..... B04C 5/12 209/729
4,571,301 A * 2/1986 Inskeep, Jr. ..... C02F 1/00 210/304
4,729,772 A * 3/1988 Asanuma ..... B04C 5/00 95/1
7,318,527 B2 * 1/2008 Branner ..... B01D 21/2461 209/1

FOREIGN PATENT DOCUMENTS

EP 0163749 A1 12/1985
FR 2868968 A1 10/2005

* cited by examiner

HYDRODYNAMIC REMOVAL OF DENSE MATERIALS FROM A SLURRY

FIELD

The invention relates to an apparatus for the removal of dense materials from a slurry of components with different densities and different particle structures.

BACKGROUND

In the wet mechanical processing of material mixtures, e.g. waste, mechanically removed waste fractions or commercial residues, slurry is produced, e.g. pulps or suspensions, which still contain relevant amounts of materials that can sediment in water or that have sharp edges, e.g. gravel, grit, stones, ceramic or glass fragments or metal particles, which cause operating problems, e.g. deposits or wear, in downstream process stages. This results e.g. in layers of sediment in containers which necessitate laborious emptying after a few years of operation, the laying of pipelines that require a large cleaning effort, or a large degree of wear of the machine technology caused by the mostly abrasive properties of these materials.

Organic waste suitable for fermentation may contain mineral dense materials of 4% by weight (Kübler, H., Hoppenheidt, K., Hirsch, P., Kottmair, A., Nimmrichter, R., Nordsieck, H., M., Mücke, W., Swerev (2000) Full scale co-digestion of organic waste. Water Science & Technology 41, 195-202). Communal bio-waste contains relevant amounts of mineral dense materials such as stones, glass fragments, grit, gravel or sand which, according to the studies carried out by Kranert et al. (Kranert, M., Hartmann A., Graul S. (1999) Determination of sand content in digestate. In: W. Bidlingmaier et al. (editor) Proceedings of the International Conference ORBIT 99 on Biological Treatment of Waste and the Environment, Part I, pages 313-318) can make up a portion of the dry mass of the waste of partially over 25% by weight. During wet mechanical processing of the bio-waste a substantial part of these mineral dense materials is carried into the pulp which is then taken for biological recycling. Studies carried out by Kübler et al. (Kübler, H., Nimmrichter, R., Hoppenheidt, K., Hirsch, P., Kottmair, A., Nordsieck, H., Swerev, M., Mücke, W. (1998) Full scale co-digestion of biowaste and commercial organic waste. Materials and Energy from Refuse. P. De Bruycker and J. Kretschmar (editor), Techological Institute of Antwerp, pages 195-202) show that in the wet mechanical processing of bio-waste a pulp is produced from which hydrodynamic separation of dense materials removes approx. 3% by weight of the moist mass of the waste being treated as dense materials.

During the operation of waste treatment plants in which the sieved out fraction of less than 80 mm is taken for wet processing, in this fraction a portion of glass particles and mineral components of 12 to 14% by weight was determined in the moist mass of this fraction (Rita, J., Braga, J., Mannall, C., Goldsmith, S., Kübler, H., Rahn, T., Schulte S. (2015) Compost-like material or thermal valorisation—impact on MBT Plant economics and environmental aspects—case studies in Portugal and UK. In: M. Kühle-Weidemeier and M. Balhar (editor) Energy and raw materials from residue and bio-waste, Cuvillier Verlag Gottingen, pages 395-406).

In order to ensure disruption-free recycling of the slurries or suspensions from the wet processing, the easily sedimentable portions are often removed from the suspension. For this purpose dense material separators are used. In addition to the removal of the extraneous materials, these dense material separators must however also minimize discharge of the other components present in the slurry and should be recycled in the downstream process stages, e.g. fermentable organic materials. This can be achieved by a combination of a hydrocyclone and a classifying tube which is disposed in the lower section of the hydrocyclone for the discontinuous discharge of the dense materials that have been removed. In order to reduce the discharge of the other components, flushing liquid is often delivered to the classifying tube. In this way a counter-flow is generated in the classifying tube which releases the dense materials that have been removed from the other components of the slurry.

This type of apparatus is described in DE 195 05 07 A1, which apparatus has a flat bottomed hydrocyclone for the removal of dense materials from a slurry which was generated from waste materials. A classifying tube is positioned downstream of the flat bottomed hydrocyclone in order to increase the selectivity of the dense material separator. The dense materials that are removed are collected in the lower section of the classifying tube by means of a sluice system with an integrated chamber and are discontinuously discharged. If subsequently to emptying the chamber the shut-off valve to the classifying tube is opened, the content of the classifying tube and part of the content of the hydrocyclone is emptied all at once into the chamber. On the other hand it may be that the dense materials located within the chamber cement and so make it difficult, if not actually prevent, discharge from the chamber. In this way the zone for the selective removal of dense materials is disrupted and the selectivity of the separation result is worsened. In said document reference is also made to the fact that the cleaning effect of the classifying tube is improved if a flushing liquid is delivered to the classifying tube against the pressure that prevails in the hydrocyclone and is discharged via the upper section of the cyclone. Tap water or some other liquid is provided as the flushing liquid.

SUMMARY

During operation of this type of hydrodynamic dense materials separator, the degree of removal of the sedimentable components as well as the discharge of other components is greatly influenced by the flow of flushing water which generates a counter-flow in the classifying tube. Here the flow of flushing water has opposing effects in relation to the desired separation of the fractions: Reduction of the flow of flushing water leads to improved removal of the easily sedimentable components from the suspension, but increases the portion of the biologically recyclable components in the dense materials fraction that is removed. These are therefore withdrawn from the downstream process stages for the recycling of the suspension. However, an increase in the flow of flushing water has the opposite effect, namely the portion of biologically recyclable components in the fraction of dense materials that have been removed sinks, but the removal of easily sedimentable components from the suspension worsens. FIG. 1 shows this opposite effect by means of operating results of a process stage with hydrodynamic separation of dense materials in a fermentation plant for 75,000 Mg/a organic waste.

In order to limit the fresh water requirement, and consequently also the resultant waste water, it is important—especially for economic and also for ecological reasons—to use tap water which is re-circulated in the plant as the flushing water (process water). This requires a process stage which makes the process water available at sufficiently high pressure in relation to the pressure level in the dense materials separator. From the perspective of cost and space requirement, the diameters of the process water pipes must be limited. It has been recognised here by the inventors that in the prior art periodically high process water requirement peaks occur in the dense materials separator itself as well as in other upstream or downstream units of the wet mechanical processing plant. This leads to considerable pressure fluctuations always occurring in the process water supply of the classifying tube.

It is an object of the invention to improve the degree of separation of the apparatus and to reduce contamination of the fraction that has been removed. This object is achieved by embodiments of our apparatus and can also be achieved via use of an embodiment of our method.

In consideration of the effects of the flow of flushing water described above, an optimum amount and pressure for the flow of flushing water to the classifying tube can be determined dependently upon the requirement profile for operation of the plant, and the volumetric flow of the flushing water can be set accordingly. Furthermore, the consumption of flushing water to the storage chamber can be minimized.

The control technology of the present invention can take into account the considerable fluctuations in pressure in the supply of flushing water to the classifying tube and the storage chamber that is described above. In this way the negative impact upon the separating performance can be eliminated, by means of which the separating quality of the dense materials that have been removed increases and this results in a reduced requirement for flushing water.

Embodiments of the invention can be configured to set the flow of flushing water relates on the one hand to the feed to the classifying tube and on the other hand to the storage chamber separated from the classifying tube and into which the dense materials that have been separated out are introduced. In other words, both the classifying tube and the separate storage chamber are charged with flushing water. This takes place such that the feed to the classifying tube is regulated and the feed to the storage chamber takes place in a controlled manner. While the regulation makes a comparison between the actual state and the nominal state, and dependently upon this operates an actuator, the control of the feed to the storage chamber concentrates upon the detection of the actual state in order to operate a corresponding actuator.

With regard to DE 195 05 073 A1 the disadvantageous effect of the abrupt emptying of the classifying tube in the prior art has already been discussed. In order to now prevent this abrupt emptying of the classifying tube into the separate storage chamber provision can be made to flood the storage chamber with flushing water in a controlled manner subsequent to emptying. The required ventilation of the chamber can take place here by means of a ventilation or overflow opening disposed on the upper end of the chamber.

In order to minimize the flushing water requirement for the storage chamber and to resolve a problem in the prior art above, namely that in a storage chamber that is only partially filled with flushing water, by opening the shut-off valve (e.g. shut-off valve (10) shown in FIG. 3) to the classifying tube the zone of the selective removal of the dense materials is disrupted and the selectivity of the separation result is worsened, the dense materials separator in embodiments of the apparatus can be equipped with a mechanism (e.g. sensor (9) shown in FIG. 3) for detection of the dense materials filling level in the storage chamber in order to initiate its emptying and detection of the flushing water overflow when it is filled with flushing water.

The emptying of the storage chamber may only take place when the maximum filling level of dense materials in the storage chamber is determined by measuring. This can permit total filling of the storage chamber to be guaranteed, and consequently the number of required emptying processes to be minimized. The filling of the storage chamber with the flushing water only ends when process water is detected in the overflow of the storage chamber. Both equipping features lead to a minimum requirement for flushing water.

This process of filling the chamber with process water may also take place in a time-controlled manner and with a guarantee of a full storage chamber being measured. The control system can be configured to take into account the following facts here:

In order to prevent a backlog of dense materials in the classifying tube which may cause blockage of the classifying tube, the emptying of the storage chamber must take place sufficiently early. For this reason the storage chamber is often not totally filled with removed dense materials upon emptying. In order to be able to remove the same amount of dense materials, more emptying/filling cycles are therefore required. Since the storage chamber must be filled with flushing water again before opening the shut-off valve (e.g. shut-off valve (10) shown in FIG. 3) to the classifying tube, a higher number of emptying/filling cycles leads to greater flushing water consumption.

In another preferred embodiment, the emptying of the storage chamber is initiated by the detection of the maximum filling level of dense materials and the delivery of process water when filling the emptied storage chamber is ended by detection of the overflow of process water from the chamber. The emptying of the storage chamber takes place after detection of the maximum dense materials filling level by the shut-off valve to the classifying tube (e.g. shut-off valve (10) shown in FIG. 3) closing and the lower shut-off valve (e.g. shut-off valve (11) shown in FIG. 3) of the storage chamber opening.

In one advantageous embodiment short bursts of flushing water are delivered to the storage chamber in a time-controlled manner in order to prevent cementing of the dense materials bulk in the storage chamber. Thus, all of the bulk can fall out or be removed when the chamber is opened.

In order to regulate the flow of flushing water to the classifying tube, these actuators are combined with a flow meter for the flushing water. This flow meter must be suitable for flows of water that contain solids. The detection of the overflow of the process water that contains solids for filling the chamber takes place by means of a capacitive proximity switch or an infrared light barrier.

Other details, objects, and advantages of the apparatus and method will become apparent as the following description of certain exemplary embodiments thereof proceeds.

BRIEF DESCRIPTION OF THE DRAWINGS

Embodiments of the invention is explained below with reference to the attached drawings. It should be understood that like reference numbers used in the drawings may identify like components. The drawings include.

DETAILED DESCRIPTION OF EXEMPLARY EMBODIMENTS

For the production of flushing water when processing material mixtures the process water for flushing purposes is first of all generated as part of the process by means of solid/liquid separation. In particular when processing and recycling organic waste the generation of process water with a low solid content is problematic. This is due to the fact that suspensions from organic waste contain fibrous as well as very fine-grained slimy components with a small density difference. This leads to the process water extraction providing a flushing water with a considerable content of suspended materials of 1 to 10 g/l with the commercial use of precipitating and flocculating agents. Also with two-stage dewatering, such as a combination of a decanter centrifuge with polymer metering and then fine screening of the centrate, e.g. by means of a 250 μm slotted screen, the concentration of the suspended materials in the process water is often in the region of 0.5 to 4 g/l.

In order to achieve an even supply of flushing water the choice of actuator depending on the portion of slurry in the process water may be decisive here. This is especially due to random partial displacement by the materials suspended in the process water in the actuator. Actuators comprised of discs which are adjusted relative to one another about an axis and the opposing movements of which change the free passage with infinite variation, hose pinch valves, ball sector valves or ball valves have proven to be suitable as actuators.

Due to the aforementioned pressure fluctuations in the supply of process water to be managed by the inventor, in this regard the volumetric flow varies accordingly when filling the storage chamber. The result of this is that appropriate amounts of time are to be set aside for the filling process in order to ensure total filling of the chamber. These time reserves may lead to unnecessarily large volumes of process water which must be processed and kept at pressure. In order to avoid this, the amount of process water required to fill the chamber in an advantageous embodiment is minimized either by means of a filling level measurement in the storage chamber (e.g. via sensor (9)) or by means of detection of the process water overflow from the storage chamber (e.g. via detection means (7)).

Figure 3:
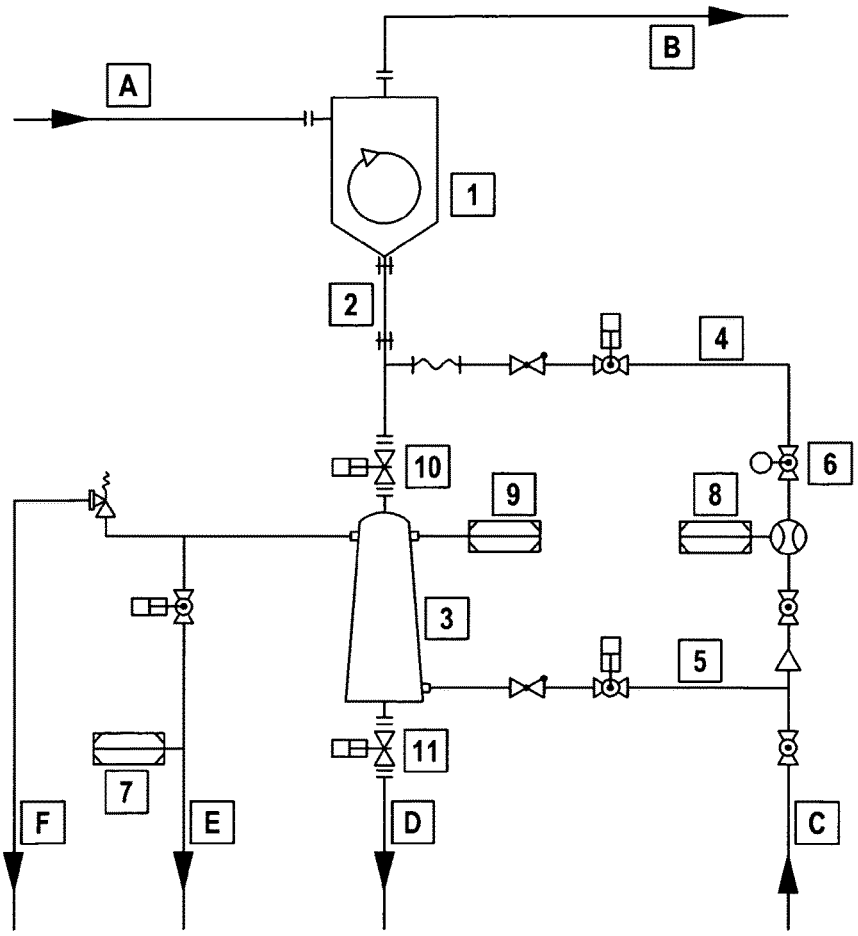
FIG. 3, which is a schematic diagram of an embodiment according to the invention of an apparatus for hydrodynamic dense material separation.

FIG. 3 shows a diagram of an embodiment according to the invention of an apparatus for hydrodynamic separation of dense materials comprising a hydrocyclone (1), a classifying tube (2) connected to a shut-off valve (10) and a storage chamber (3) connected to a lower shut-off valve (11). Flows of material (e.g. flushing water, process water, dense materials, etc.) in FIG. 3 include flows A, B, C, D, E, and F labeled in FIG. 3. In the embodiment according to the invention of this apparatus for hydrodynamic separation of dense materials the flow of flushing water to the classifying tube (2) via flow path (4) is regulated and guided to the storage chamber (3) via a control circuit and the actuator (6) via flow path 5. In a preferred embodiment the flow of flushing water into the classifying tube (2) is set by means of an actuator (6) which is not easily displaced by suspended materials and has a self-cleaning effect, as specified above. The control circuit can include a controller that is configured to help regulate the flow of flushing water to provide a guiding jump response for the control circuit (see e.g. discussion provided herein and FIG. 4). The control circuit can also include a control element provided at the feed to the classifying tube (2) and a control element provided at the feed to the storage chamber (3).

In another preferred embodiment the supply of process water when filling the emptied storage chamber is controlled by detection of the overflow of process water from the chamber via a detector (7) or a detection mechanism. In order to regulate the flow of flushing water the elements specified above as appropriate actuators are combined with a flow meter (8) for the flushing water in a preferred embodiment. This flow meter (8) must be appropriate for water flows which contain solids (e.g. slurries). The overflow of the process water that contains solids for filling the chamber may be detected by detection means (7), which can include a capacitive proximity switch or an infrared light barrier in some embodiments.

Attempts to control the upwards flow of flushing water within the classifying tube by means of a ball valve was found to provide satisfactory results. The following table 1 shows the development of the upwards flow of flushing water over the trial period. The nominal value of the upwards flow of flushing water was 500 l/h. The positioning of the ball valve was corrected manually here as required. The ball valve was periodically fully opened for a short time in order to flush away solid accretions.

TABLE 1

| Trial | Upwards flow of flushing water | | Flushing |
|---|---|---|---|
| duration [min] | Current value [l/h] | Corrected value [l/h] | process performed |
| 0 | 500 | 500 | No |
| 15 | 481 | 498 | No |
| 30 | 487 | 502 | No |
| 45 | 469 | 500 | No |
| 60 | 451 | 505 | No |
| 75 | 425 | 500 | Yes |
| 90 | 458 | 500 | No |
| 105 | 490 | 503 | No |
| 120 | 473 | 505 | No |
| 135 | 498 | 498 | No |
| 150 | 479 | 500 | No |
| 165 | 466 | 497 | No |
| 180 | 453 | 502 | No |
| 195 | 438 | 497 | Yes |
| 210 | 489 | 501 | No |
| 225 | 473 | 498 | No |
| 240 | 478 | 503 | No |

However, for such controls of material flows that contain solids ball sector valves are superior to a ball valve in terms of construction because the seals in the ball sector valve are exposed less to the abrasive dense materials.

Motor regulating valves in a flat rotary slide construction in the throttle device enable a linear flow change. In association with an electric motor such valves constitute a proportional regulating actuator which also ensures a constant flow of flushing water with process water that contains solids. In order to keep the flow of flushing water as constant as possible when the flow supply stops, the regulation is designed such that if there is power failure, the previously adopted valve position is maintained.

Figure 4:
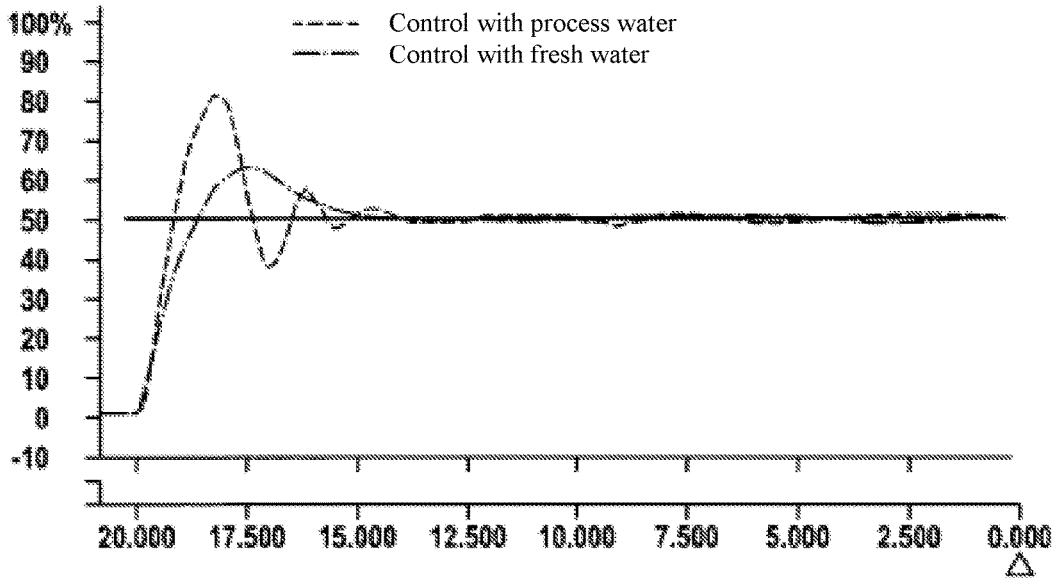
FIG. 4, which is a graph illustrating a guidance jump responses of the control circuit with a flow of 500l/h for fresh water and process water that contains solids.

Experiments with water to consider the regulating characteristics of the regulation of upwards flow by means of a flat rotary slide throttle device showed rapid adjustment at the start of the system and with changes to the nominal value as well as good regulating characteristics for the correction of pressure changes (FIG. 4). The setting of the regulator by means of the Ziegler Nichols method gives a good regulating result. Since the volumetric flow of the upwards flow of water has a clear effect upon the guiding jump response sequence of the control circuit, adjustment of the regulator with the nominal flow leads to the best regulating result. It was shown here that a PI (Proportional Integral) controller is sufficient and leads to less stressing of the actuator. A regulator paramaterized with fresh water does not show optimal regulating characteristics with flushing water charged with solids due to the greater overshoot width and the greater correction time (FIG. 4). Consequently, the regulator must be set with the flow of flushing water of the operational plant.

Figure 1:
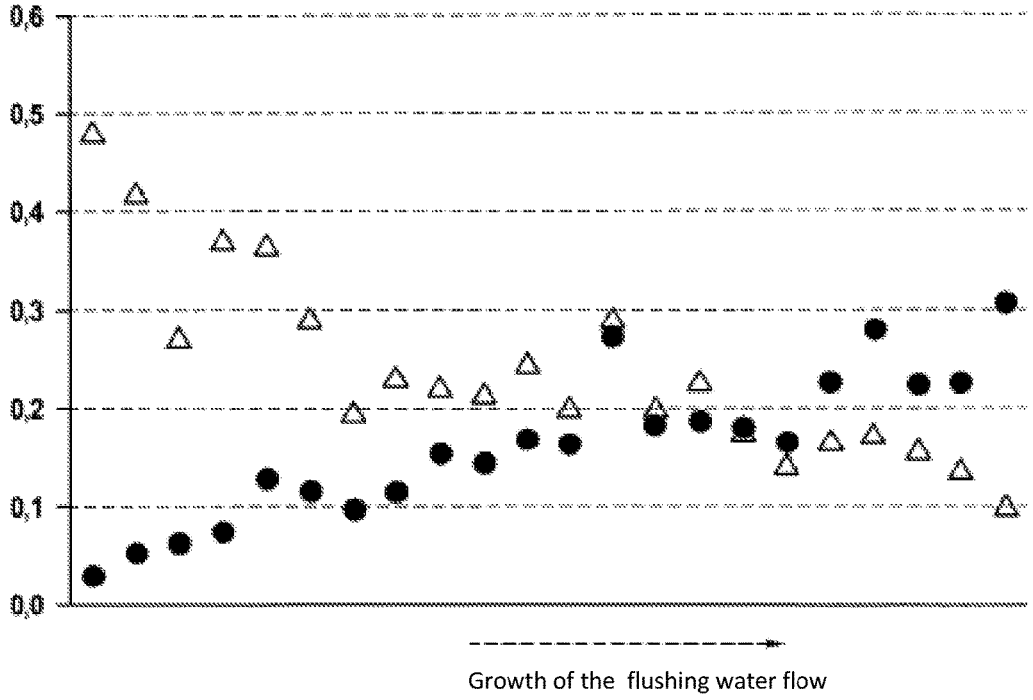
FIG. 1, which is a graph illustrating the concentration of easily sedimentable mineral materials in a waste suspension after hydrodynamic separation of dense materials in 10 g/l (●) and the portion of organic material in the dry mass of the dense materials that have been removed (Δ) dependently upon the increase in the flow of flushing water.
Figure 2:
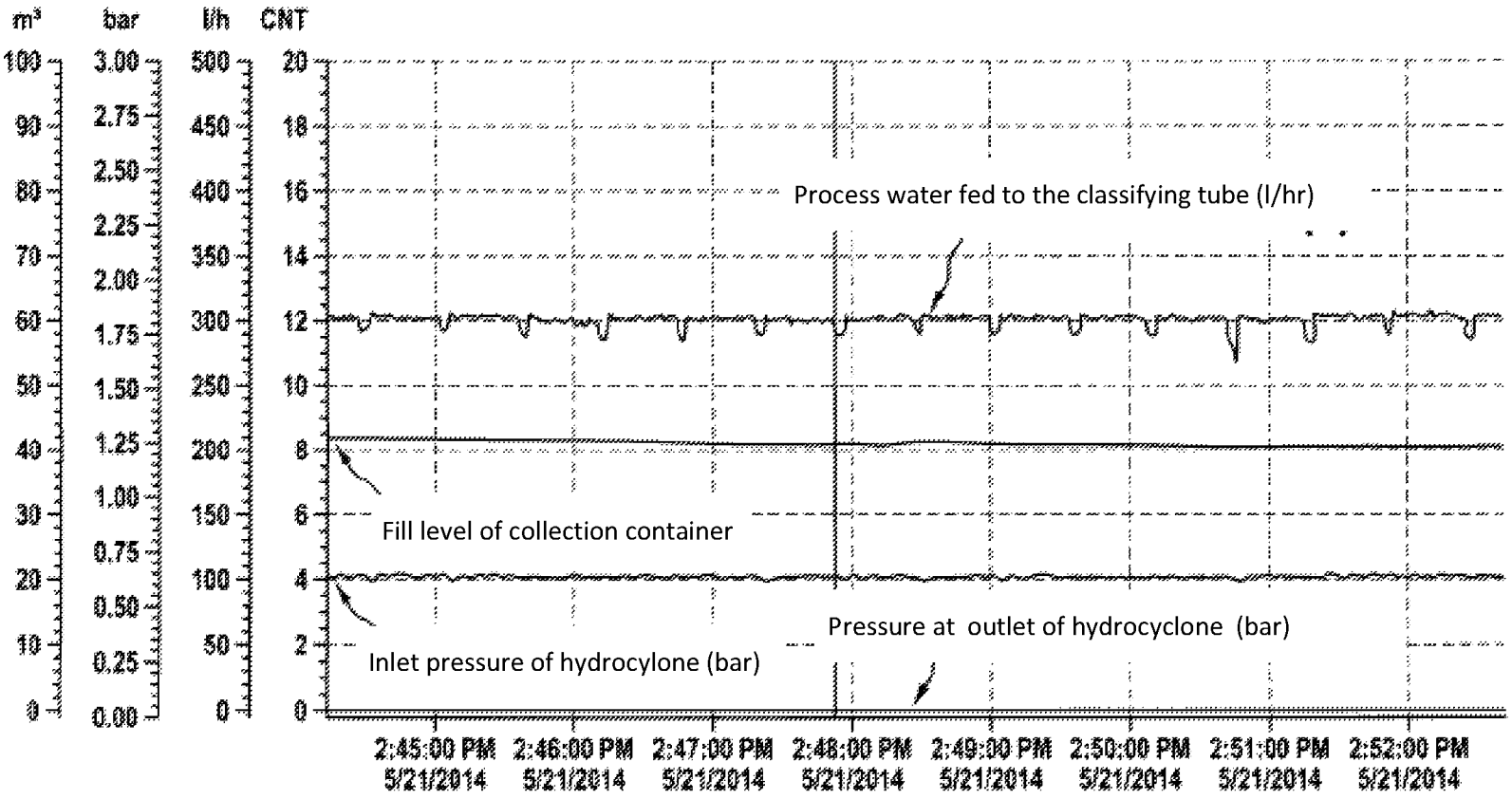
FIG. 2, which is a graph illustrating a regulated flow of flushing water to the classifying tube when using a process water that contains suspended materials, with the use of a disc actuating element with integrated flow measurement.

FIG. 2 shows the operational result of the hydrodynamic dense materials separator with a regulated flow of flushing water to the classifying tube when using process water that contains suspended materials and uses a flat rotary slide throttle device in combination with an upstream magnetically inductive flow measurement. By means of these system components the supply of process water containing solids to the classifying tube could be kept relatively constant at the nominal value.

In general, displacement of the valves by suspended materials cannot be entirely ruled out. Therefore, in order to eliminate such displacement, in one advantageous embodiment the actuator is deliberately moved fully forwards for a short period of time so that any possible displacement is entirely eliminated. This short-term full opening takes place in a time-controlled manner and assists with the re-setting of a constant flow of flushing water.

Experiments with fresh water and also with process water showed that upon filling the chamber in its overflow pipe, the phase change between the ventilation air and the overflowing liquid can be measured reliably by means of a capacitive proximity switch or an infrared light barrier.

While certain exemplary embodiments of the apparatus for hydrodynamic dense material separation and methods of making and using the same have been shown and described above, it is to be distinctly understood that the invention is not limited thereto but may be otherwise variously embodied and practiced within the scope of the following claims.

The invention claimed is:

1. An apparatus for the hydrodynamic removal of dense material from a slurry, comprising:

a hydrocyclone that receives the slurry, a classifying tube adjoining the hydrocyclone, and a separate storage chamber that receives dense materials that have been separated out from the slurry, a flow of flushing water to the classifying tube controlled via a control circuit, the control circuit comprising an actuator, a flow of flushing water to the storage chamber controlled via the actuator, the control circuit also comprising at least one sensor being positioned to detect a filling level of the dense materials and a flushing water overflow of the storage chamber.

2. The apparatus according to claim 1, wherein the actuator is a throttle device in which discs are adjusted relative to one another over an axis, and the movement of which in opposing directions changes a free passage.

3. The apparatus according to claim 1, wherein the actuator is a flat rotary slide.

4. The apparatus according to claim 1, wherein the actuator is a hose pinch valve.

5. The apparatus according to claim 1, wherein the actuator is a ball valve or a ball sector valve.

6. The apparatus according to claim 1, wherein the separate storage chamber receives the dense materials that have been separated out from the slurry via the hydrocyclone and the at least one sensor includes a detector that detects the filling level of the dense materials in the storage chamber to initiate emptying of the storage chamber and detection of flushing water overflow when the storage chamber is filled with flushing water.

7. The apparatus according to claim 2, wherein the control circuit includes a flow meter positioned to measure the flow of flushing water to the classifying tube.

8. The apparatus according to claim 7, wherein the flow meter is a magnetically inductive flow meter.

9. The apparatus according to claim 1, wherein the at least one sensor includes detection means for detecting flushing water in an overflow on the storage chamber.

10. The apparatus according to claim 9, wherein the detection means for detecting overflowing flushing water include a capacitive proximity switch.

11. The apparatus according to claim 9, wherein the detection means for detecting overflowing flushing water include an infrared light barrier.

12. The apparatus according to claim 9, wherein the at least one sensor can include means for detecting the filling level of the dense materials that has vibration limit switch.

13. A method for the hydrodynamic removal of dense material from a slurry, comprising:

delivering slurry to a hydrocyclone, separating out dense materials from the slurry for conveying the separated out dense materials into a classifying tube into which flushing water is introduced for further separation, sedimenting the dense materials that are separated in a separate storage chamber, and delivering a flow of flushing water to the classifying tube in a controlled manner by means of a control circuit, the control circuit comprising an actuator and a sensor, a detected filling level of the storage chamber detected by the sensor in order to flood the storage chamber with flushing water in a controlled manner based on the detected filling level.

14. The method according to claim 13, wherein the actuator is a throttle device that is fully opened for short intervals of time to control the flow of flushing water to the classifying tube in a time-controlled manner.

15. The method according to claim 13, wherein the flow of flushing water to the classifying tube is controlled by means of a magnetically inductive flow meter.

16. The method according to claim 13, wherein the flow of flushing water to the classifying tube is controlled with a PI controller.

17. The method according to claim 13, wherein parameterisation of the control of the flow of flushing water to the classifying tube takes place with nominal flow of the flushing water.

18. The method according to claim 13, comprising:

ending the filling of the storage chamber with flushing water in response to detection of flushing water at an overflow.

19. The method according to claim 13, wherein flushing water is temporarily delivered to the storage chamber in a time-controlled manner.

20. The method according to claim 13, wherein the separating out dense materials from the slurry for conveying the separated out dense materials into a classifying tube into which flushing water is introduced for further separation is performed via the hydrocyclone, and wherein the actuator is comprised of one of:

a throttle device in which discs are adjusted relative to one another over an axis, and movement of which in opposing directions changes a free passage;

a flat rotary slide;

a hose pinch valve;

a ball sector valve; and a ball valve.

* * * * *